US009121611B2

(12) United States Patent
Koizumi et al.

(10) Patent No.: US 9,121,611 B2
(45) Date of Patent: Sep. 1, 2015

(54) COMBUSTOR, BURNER, AND GAS TURBINE

(75) Inventors: Hiromi Koizumi, Hitachi (JP); Shohei Yoshida, Hitachiota (JP); Satoshi Dodo, Kasama (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 667 days.

(21) Appl. No.: 13/552,723

(22) Filed: Jul. 19, 2012

(65) Prior Publication Data

US 2013/0029277 A1 Jan. 31, 2013

(30) Foreign Application Priority Data

Jul. 27, 2011 (JP) ..... 2011-164312

(51) Int. Cl.

| | |
|---|---|
| ***F23R 3/28*** | (2006.01) |
| ***F23R 3/10*** | (2006.01) |
| ***F23R 3/34*** | (2006.01) |
| *F23R 3/54* | (2006.01) |

(52) U.S. Cl.

CPC ... *F23R 3/28* (2013.01); *F23R 3/10* (2013.01); *F23R 3/343* (2013.01); *F23R 2900/00002* (2013.01); *F23R 2900/00004* (2013.01)

(58) Field of Classification Search

CPC ..... F23R 3/00; F23R 3/10; F23R 3/02; F23R 3/04; F23R 2900/00002

USPC ..... 431/354, 144, 12; 60/800, 725, 739, 60/737

See application file for complete search history.

(56) References Cited

U.S. PATENT DOCUMENTS

| | | | | |
|---|---|---|---|---|
| 8,371,125 | B2 * | 2/2013 | Miura et al. | 60/772 |
| 8,505,302 | B2 * | 8/2013 | Uhm et al. | 60/737 |
| 8,763,399 | B2 * | 7/2014 | Dodo et al. | 60/737 |
| 2004/0011054 | A1 | 1/2004 | Inoue et al. | |
| 2008/0078160 | A1 | 4/2008 | Kraemer et al. | |
| 2008/0268387 | A1 | 10/2008 | Saito et al. | |
| 2010/0218501 | A1 | 9/2010 | York et al. | |
| 2011/0076628 | A1 | 3/2011 | Miura et al. | |
| 2013/0122438 | A1 * | 5/2013 | Stoia et al. | 431/144 |

FOREIGN PATENT DOCUMENTS

| | | | |
|---|---|---|---|
| JP | 5-86902 | A | 4/1993 |
| JP | 2003-148734 | A | 5/2003 |

(Continued)

OTHER PUBLICATIONS

Japanese Office Action with English translation dated Aug. 6, 2013 (seven (7) pages).

*Primary Examiner* — Steven B McAllister
*Assistant Examiner* — Nikhil Mashruwala
(74) *Attorney, Agent, or Firm* — Crowell & Moring LLP

(57) ABSTRACT

A combustor is provided that can ensure combustion stability even when operated on low BTU gas without needing any equipment for preventing back-flow of fuel gas during operation on pilot fuel. The combustor includes a first perforated plate disposed upstream of a combustion chamber, the first plate having a plurality of nozzle holes and air holes; a second perforated plate disposed on the upstream side of the first plate; and a plurality of gas nozzles each of which is inserted into corresponding nozzle holes. The gas nozzle has a leading end located inside the corresponding one of the nozzle holes. Each of the gas nozzles includes a jet hole portion having a diameter smaller than that of a gas jet hole of the gas nozzle; and a passage portion designed to form an air passage on the outer circumference of the leading end portion of the gas nozzle.

11 Claims, 6 Drawing Sheets

(56) References Cited

FOREIGN PATENT DOCUMENTS

| | | | |
|---|---|---|---|
| JP | 2007-232325 | A | 9/2007 |
| JP | 2008-89297 | A | 4/2008 |
| JP | 2008-292138 | A | 12/2008 |
| JP | 2009-74706 | A | 4/2009 |
| JP | 2010-203758 | A | 9/2010 |
| JP | 2011-75172 | A | 4/2011 |
| JP | 2011-112286 | A | 6/2011 |
| WO | WO 2010/141777 | A1 | 12/2010 |

* cited by examiner

COMBUSTOR, BURNER, AND GAS TURBINE

BACKGROUND OF THE INVENTION

1. Field of the Invention

The present invention relates to a combustor, a burner, and a gas turbine.

2. Description of the Related Art

Fuel having a calorific value lower than that of liquefied natural gas (LNG) which is popular fuel for gas turbines is hard to be burnt generally because of low flame temperature and lower burning velocity. However, such fuel, i.e., low calorific gas is characterized by a small amount of NOx emissions during burning. Examples of such low BTU gas typically include blast furnace gas (BFG). Blast furnace gas is side product gas which is produced by a blast furnace in an iron manufacturing process. In recent years, there has been a growing need for blast furnace gas as gas turbine fuel. However, the blast furnace gas is incombustible because of containing a large amount of $N_2$ and $CO_2$ in addition to carbon monoxide (CO) and hydrogen ($H_2$) which are main constituents. Thus, it is difficult for a gas turbine to operate on mono-fuel combustion using blast furnace gas in a range from ignition to a full load. To stably operate a gas turbine (to stably burn blast furnace gas) in a range from ignition to a partial load, pilot fuel for start-up is additionally needed.

Examples of low BTU gas include also gasification gas such as coal or biomass (woodchips or the like) in addition to blast furnace gas. There is a growing need for fuel created from coal or the like as fuel for gas turbines in view of the efficient use of resources. However, such fuel created from coal or the like is incombustible gas containing a large amount of $N_2$; therefore, naturally, pilot fuel is additionally needed.

Because of this, in order for a combustor to achieve flame stabilization of incombustible gas, it is general to adopt diffusion combustion in which fuel and air are supplied from respective different flow passages and to configure a burner capable of burning dual fuel consisting of pilot fuel (e.g., liquid fuel) and low BTU gas. As one example, JP-5-86902-A describes a burner in which a liquid fuel nozzle is disposed at a radially central portion, with the liquid fuel nozzle designed to operate in a range from the start to partial load of a gas turbine, and gas jet holes are arranged on the outer circumference of the liquid fuel nozzle.

On the other hand, high calorific gas such as LNG or the like has high flame temperature; therefore, it is necessary to devise a reduction in the amount of NOx emissions. Examples of a combustion method for reducing the amount of NOx emissions include distributed lean burn. This distributed lean burn is a combustion system as below. Fuel and air are coaxially jetted toward air holes installed in a plate. Contraction flow at air flow inlets and turbulence due to abrupt expansion at air flow outlets are used to rapidly mix the fuel with air in a short distance and supply them into a combustion chamber (refer to JP-2003-148734-A). The distributed lean burn system has a short mixing length of fuel and air; therefore, it is expected to produce an effect of promoting low NOx emissions even if not only LNG but hydrogen-containing fuel having high burning velocity is used.

SUMMARY OF THE INVENTION

Low BTU gas is generally low in flame temperature; therefore, when the low BTU gas is to be used in place of high calorific gas, an opening area of a gas jet hole has to be increased, thereby ensuring the volumetric fuel flow of the low BTU gas. It is assumed here that a gas turbine having multi-can combustors is employed and operated in a range from the ignition to partial load thereof by use of pilot fuel such as liquid fuel. If the opening area of the gas jet hole is excessively increased, high temperature combustion gas may back-flow from a high-pressure side combustor to a low-pressure side combustor via the gas jet holes when unbalance in internal pressure of the combustors is created between the combustors.

To prevent the back-flow, in JP-5-86902-A, atomizing air for fuel atomization is partially jetted from the gas flow passage in the fuel nozzle into the combustion chamber to apply air pressure to the gas jet flow outlet portion of the fuel nozzle. To that end, it is necessary to additionally install a system for purge air having higher pressure than combustion air, or to increase the capacity of a compressor for supplying air for fuel atomization. Such a configuration is disadvantageous to a cost phase and to an operation phase. To cool the front surface of the fuel nozzle on the radial inside of the combustor, it is necessary to supply cooling air across a gas flow passage from the combustor-radial outside of the fuel nozzle, which makes the fuel nozzle complicated. In addition, the fuel nozzle surface can be cooled by supplying cooling air, whereas combustion stability may be likely to be impaired.

By contrast, when low BTU gas is supplied to the combustor described in JP-2003-148734-A, the incombustible low BTU gas is mixed with air and thus the stable combustion range becomes narrower than that in diffusion combustion. If, therefore, the combustor is operated as it is, the problem will be posed with combustion stability.

It is an object of the present invention to provide a combustor, a burner and a gas turbine that do not need a purge air system adapted to prevent the back-flow of high-temperature combustion gas even if being operated on pilot fuel such as liquid fuel or the like and that can ensure combustion stability even during mono-fuel combustion operation on low BTU gas.

According to the present invention, a combustor, a burner and a gas turbine are configured such that when pilot fuel such as liquid fuel is burned, a jet hole of a gas nozzle is covered by air flow to prevent the back-flow of combustion gas to the gas nozzle, and when low BTU gas is burned, it is supplied to a combustion chamber without being mixed with air, so that even low BTU gas can stably be burned through diffusion combustion.

The present invention can eliminate a purge air system adapted to prevent the back-flow of high-temperature combustion gas even when a gas turbine is operated on pilot fuel such as liquid fuel and ensure combustion stability even during mono-fuel operation on low BTU gas.

DESCRIPTION OF THE PREFERRED EMBODIMENTS

Preferred embodiments of the present invention will hereinafter be described with reference to the drawings.

First Embodiment

Configuration of a Gas Turbine

Figure 1:
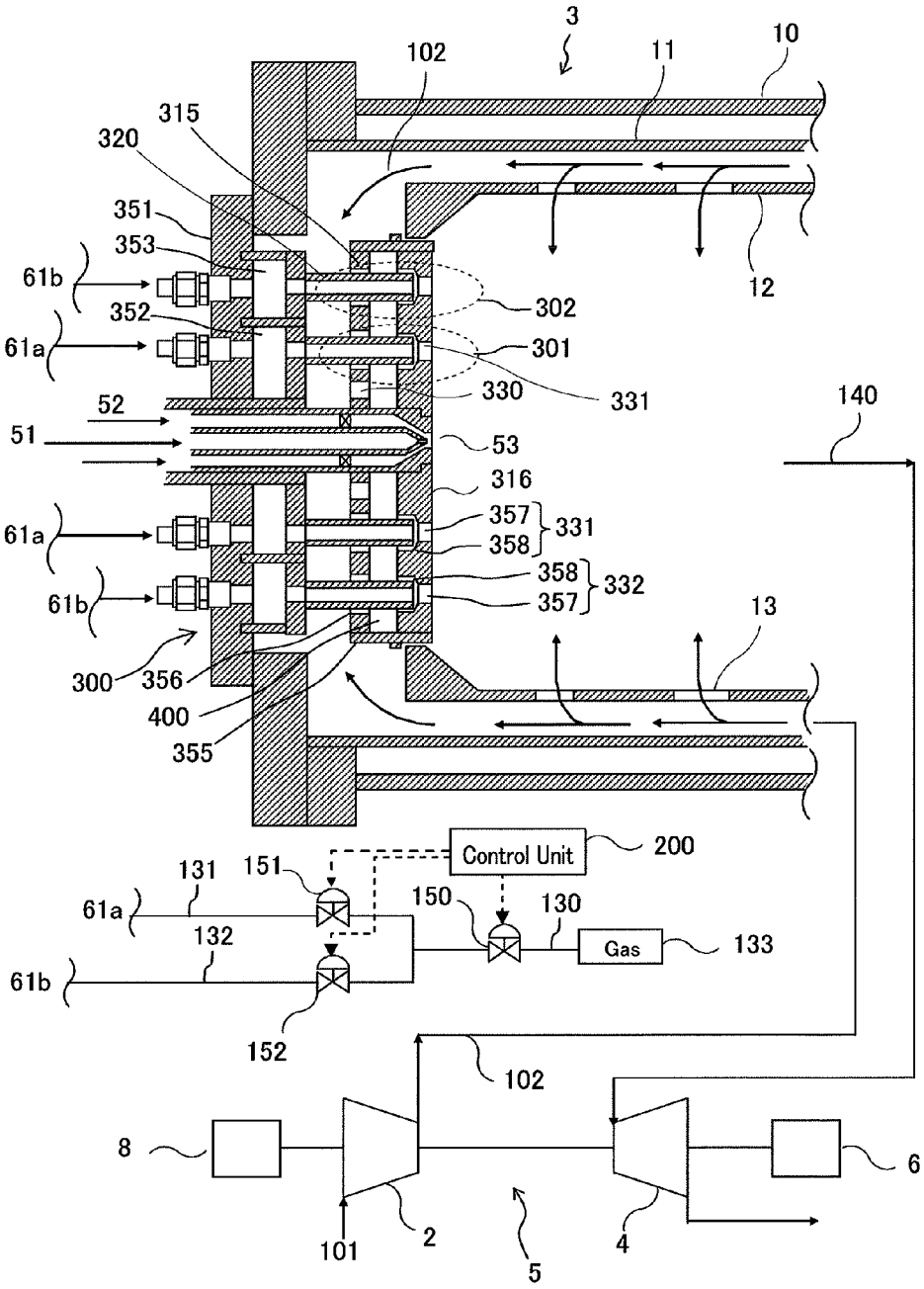
FIG. 1 includes a configurational cross-sectional view of a combustor showing a first characteristic of the present invention and a system diagram.

FIG. 1 is an enlarged cross-sectional view of an essential portion of a gas turbine according to a first embodiment of the present invention.

A gas turbine 5 shown in FIG. 1 includes a compressor 2, a combustor 3, a turbine 4, a generator 6, and a starting motor 8. The compressor 2 compresses air 101 sucked from the atmosphere. The combustor 3 burns combustion air 102 compressed by the compressor 2 along with fuel. The turbine 4 obtains rotational power from combustion gas 140 produced in the combustor 3. The generator 6 converts the rotational power of the turbine 4 into electric energy. The starting motor 8 starts the compressor 2 and the turbine 4. The compressor 2, the turbine 6 and the starting motor 8 are coaxially connected to one another.

(Configuration of the Combustor)

The combustor 3 mixes at least one of pilot fuel 51 (liquid fuel such as distillated oil in this embodiment) and low BTU gas 61*a*, 61*b* with the combustion air 102 from the compressor 2, and burns the mixed fuel or the mixed gas to produce combustion gas 140. The combustor 3 has an outer sleeve 10 which is a pressure vessel. The outer sleeve 10 incorporates the combustion chamber 12 and a combustion chamber-cooling flow sleeve 11 covering the outer circumference of the combustion chamber 12. A burner 300 adapted to eject fuel and air into the combustion chamber 12 and hold flames is disposed upstream of the combustion chamber 12 (the upstream side in the flow direction of the combustion gas 140, the same holds true for the following). The air 102 fed from the compressor 2 is distributed and supplied into the combustion chamber 12 via air holes 13 provided in the lateral surface of the combustion chamber 12 and via the burner 300 while flowing in annular space between the flow sleeve 11 and the combustion chamber 12 to cool the combustion chamber 12.

(Configuration of the Burner)

Figure 2:
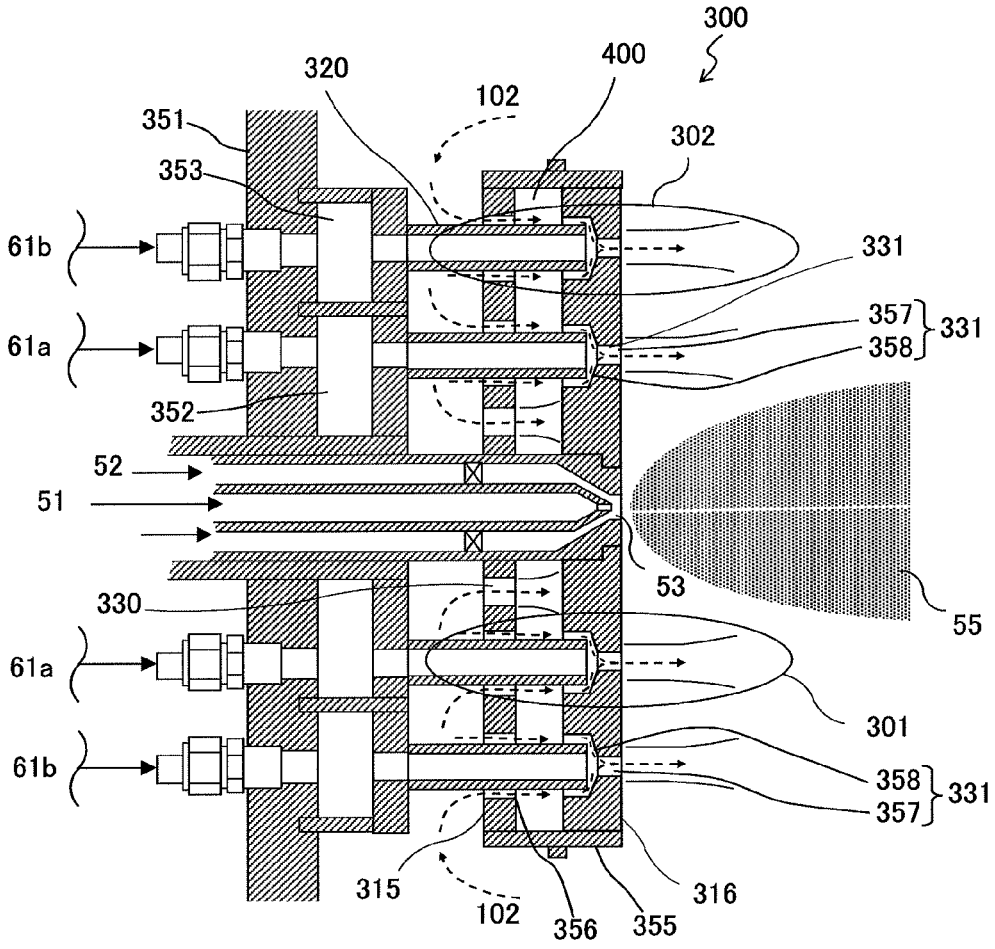
FIG. 2 is a cross-sectional view of a burner showing the first characteristic and the flow of air therein during liquid fuel burning.
Figure 3:
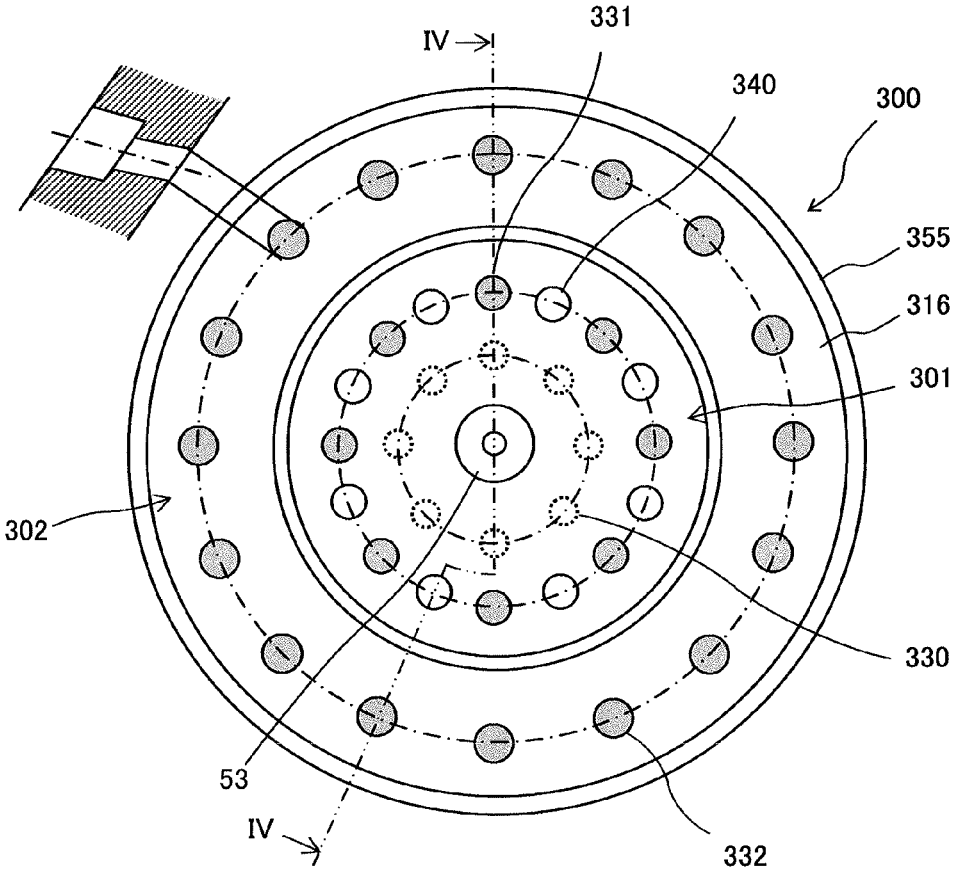
FIG. 3 is a front view of the burner showing the first characteristic of the present invention.
Figure 4:
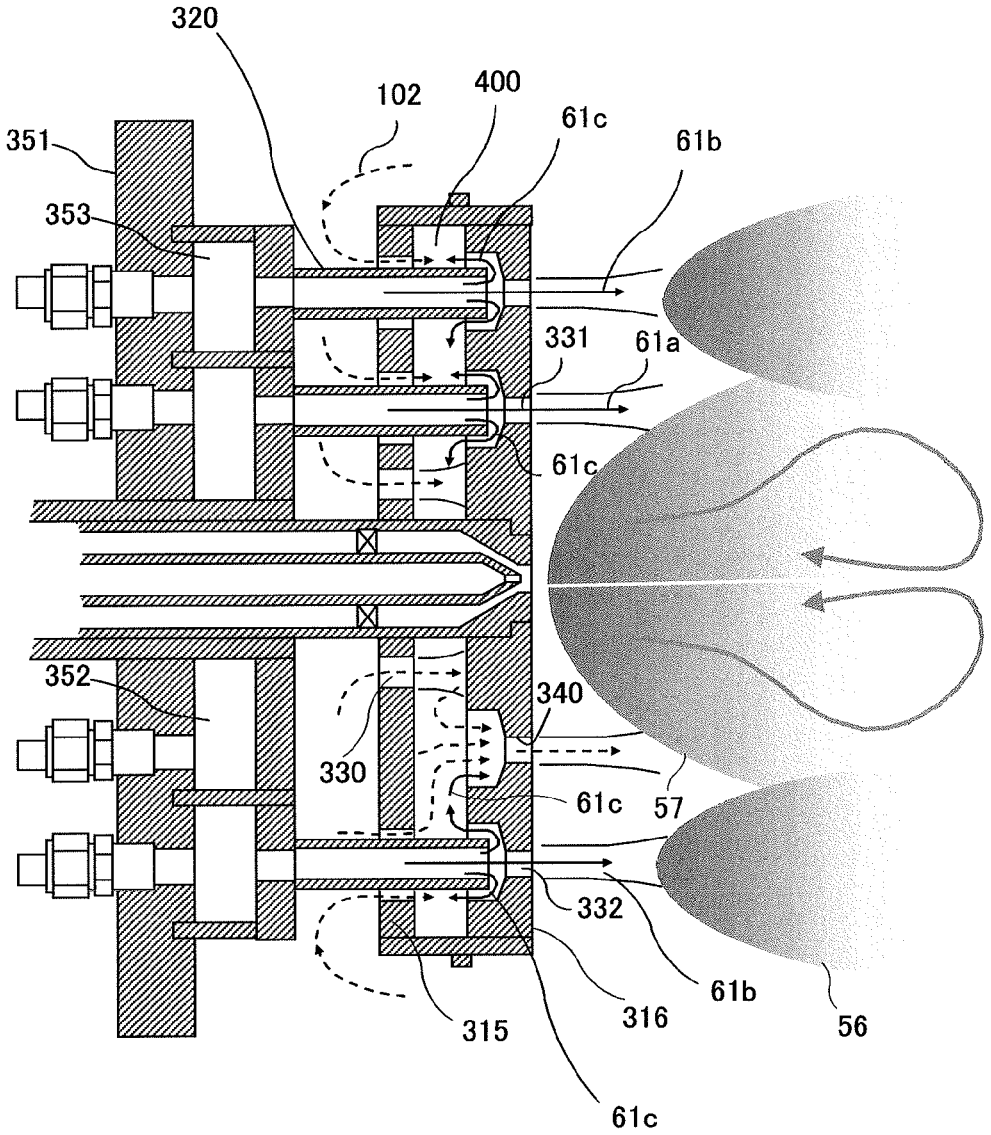
FIG. 4 is a cross-sectional view of the burner showing the first characteristic of the present invention and the flow of air therein during gas fuel burning.

FIG. 2 is an enlarged cross-sectional view of the burner 300. FIG. 3 is a front view of the burner 300 as viewed from the inside of the combustion chamber 12. FIG. 4 is a cross-sectional view taken along line IV-IV in FIG. 3.

Referring to FIGS. 2 and 3, the burner 300 includes a burner body flange 351 secured to an upstream side end of the outer sleeve 10; and a pilot nozzle 53 extending toward the combustion chamber 12 from the radially (the radial direction of the combustor, the same holds true for the following) central portion of the flange 351. The burner 300 further includes annular gas chambers 352, 353 formed concentrically on the downstream side of the flange 351 (the downstream side in the flow direction of the combustion gas 140, the same holds true for the following) and centered on the pilot nozzle 53; a plurality of gas nozzles 320 extending from the gas chambers 352, 353 toward the combustion chamber 12; and a perforated plate 316 with swirling air holes disposed on the upstream side end portion of the combustion chamber 12. The perforated plate 316 with swirling air holes is hereinafter called the first perforated plate 316.

The pilot nozzle 53 is used during operation in a range from start-up to a partial load. The pilot nozzle 53 shears and atomizes pilot fuel 51 supplied from a pilot fuel system (not shown) by use of atomized air 52 (e.g. a portion of pressure-rising air from the compressor 2). In addition, the pilot nozzle 53 sprays the atomized pilot fuel 51 into the combustion chamber 12 for combustion. The pilot nozzle 53 is inserted into the radially central portion of the first perforated plate 316 and passes through a perforated plate 315 with straight air holes. In addition, the pilot nozzle 53 has a leading end portion flush with a combustion chamber 12 side end face of the first perforated plate 316. The perforated plate 315 with straight air holes is hereinafter called the second perforated plate.

The gas nozzles 320 eject low BTU gas 61*a* or 61*b* supplied from the gas chamber 352 or 353, respectively, into the combustion chamber 12 for combustion. A fuel system for the low BTU gas 61*a*, 61*b* is configured as follows. The main system 130 extends from a gas source 133. The main system 130 bifurcates into systems 131 and 132, which are connected to the gas chambers 352 and 353, respectively. Pressure control in the fuel system is performed by a pressure regulating valve 150 installed on the main system 130. Flow regulating valves 151 and 152 are installed on the systems 131 and 132, respectively. The respective flow rates of the systems 131 and 132 can be regulated by controlling the flow regulating valves 151 and 152, respectively. The pressure regulating valve 150 and the flow regulating valves 151, 152 are each controlled by a control unit 200 in accordance with an operator's instruction or a previously stored program.

The burner 300 includes the first perforated plate 316 and the second perforated plate 315 arranged in parallel. The burner 300 also includes an outer circumferential ring 355 connecting the first and second perforated plates 316, 315. In addition, the burner 300 is secured to and supported by the pilot nozzle 53.

The first perforated plate 316 is a disk-like member disposed in an upstream side portion of the combustion chamber 12, with the first perforated plate 316 assuming a posture in which its broadest end face is oriented toward the space inside the combustion chamber 12 (that is, in a posture in which the broadest end face is perpendicular to the central axis of the combustor). In addition, the first perforated plate 316 has a plurality of nozzle holes 331, 332 and air holes 340 which face the inside space of the combustion chamber 12. The plurality of nozzle holes 331 and the plurality of nozzle holes 332 are provided and each of the gas nozzles 320 faces a corresponding one of the nozzle holes 331, 332. The inside nozzle holes 331 are annularly arranged around the pilot nozzle 53. The outside nozzle holes 332 are annularly arranged on the outer circumferential side of the row of the nozzle holes 331. The present embodiment exemplifies the case where a single row of the nozzle holes 331 and a single row of the nozzle holes 332 are provided, that is, two rows of the nozzle holes are concentrically arranged. However, in some cases three or more rows of the nozzle holes will be concentrically arranged.

Incidentally, a portion shown by dotted lines 301 (FIG. 2) includes a plurality of burners composed of the inside nozzle holes 331 and the gas nozzles 320 each facing a corresponding one of the nozzle holes 331, with the portion adapted to spray gas from the gas chamber 352 into the combustion chamber 12. That portion is called a first burner portion 301. On the other hand, a portion shown by dotted lines 302 includes a plurality of burners composed of the outside burners 332 and the gas nozzles 320 each facing a corresponding one of the nozzle holes 332, with the portion adapted to spray gas from the gas chamber 353 into the combustion chamber 302. That portion is called a second burner portion 302. The first burner portion 301 includes the plurality of air holes 340 arranged in the first perforated plate 316. These air holes 340 are circumferentially arranged alternately with the nozzle holes 331. It is to be noted that, in the present embodiment, the second burner portion 302 is not provided with air holes corresponding to the air holes 340.

The second perforated plate 315 is installed on the side opposite the combustion chamber 12 with the first perforated plate 316 put therebetween. The first and second perforated plates 316, 315 and the outer circumferential ring 355 define an air chamber 400. The air chamber 400 is designed to have pressure higher than that in the inside space of the combustion chamber 12. The second perforated plate 315 is provided with a plurality of through holes 356 at respective positions each opposed axially to a corresponding one of the nozzle holes 331, 332 of the first perforated plate 316. The gas nozzles 320 pass through the respective through holes 356 and each of the gas nozzles 320 has a leading end facing a corresponding one of the nozzle holes 331, 332. The through hole 356 has a diameter slightly greater than the outer diameter of the gas nozzle 320. An annular air passage is formed on the outer circumference of the gas nozzle 320. Further, the second perforated plate 315 is provided with cooling holes 330 at such respective positions as to face the first perforated plate 316 and avoid the nozzle holes 331, 332 and the air holes 340. As shown in FIG. 3, a plurality of the cooling holes 330 are arranged concentrically with the gas nozzles 320. The cooling holes 330 are located radially inward of the inner circumferential side gas nozzles 320 so as to surround the circumference of the pilot nozzle 53. As shown in FIG. 2 and other figures, the air passages (the through holes 356) and cooling holes 330 of the second perforated plate 315 and the nozzle holes 331, 332 and air holes 340 of the first perforated plate 316 communicate with the air chamber 400.

Incidentally, the gas nozzle 320 does not completely pass through the first perforated plate 316. The gas nozzle 320 has a leading end located in the nozzle hole 331 or 332 disposed coaxially therewith. In this case, each of the nozzle holes 331, 332 has a jet hole portion 357 and a passage portion 358. The jet hole portion 357 is opposed to the combustion chamber 12 side of the gas nozzle 320 and faces the inside space of the combustion chamber 12. The passage portion 358 is located on the air chamber 400 side of the jet hole portion 357 and faces the air chamber 400. The jet hole portion 357 has a diameter smaller than that of the gas jet hole of the gas nozzle 320. The passage portion 358 surrounding the leading end portion of the gas nozzle 320 has a diameter greater than the outer diameter of the gas nozzle 320 and forms an air passage on the outer circumference of the leading end portion of the gas nozzle 320. As shown in FIG. 3, the nozzle holes 331, 332 and air holes 340 of the first perforated plate 316 are each provided in a circumferentially inclined manner so as to give a swirl component to the flow of jetted gas or air.

Incidentally, the present embodiment exemplifies the configuration in which the gas nozzle 320 passes through the second perforated plate 315 and is inserted into the first perforated plate 316. However, the gas nozzle 320 may be configured such that it passes through the outer circumferential ring 355, then is bent, and is inserted into the first perforated plate 316. The present embodiment exemplifies the case where the air passage is defined between the through hole 356 of the second perforated plate 315 and the gas nozzle 320. However, this air hole is not always needed. The burner can be configured such that the gas nozzle 320 has an outer diameter equal to the inner diameter of the through hole 356.

(Operation)

A description is given of the operation of the gas turbine configured as above.

When the gas turbine is first started up, the compressor 2 and the turbine 4 are driven by the external power of the starting motor 8 or the like. If the rotation speed of the compressor 2 is increased to and held at a rotation speed matching the ignition condition of the combustor 3, the combustion air 102 necessary for the ignition is supplied to the combustor 3 to establish the ignition condition. Thereafter, as shown in FIG. 2, the pilot fuel 51 and the atomizing air 52 are supplied to the pilot nozzle 53 so that the pilot fuel 51 is sprayed into the combustion chamber 12. The combustion air 102 supplied from the compressor 2 to the burner 300 flows into the air chamber 400 via the clearances between the through holes 356 of the second perforated plate 315 and the corresponding gas nozzles 320 and via the cooling holes 330 provided in the second perforated plate 315. The pressure on the upstream side of the first perforated plate 316 is higher than that in the air chamber 400. In addition, the air chamber 400 is higher in pressure than the combustion chamber 12. Therefore, the combustion air 102 flowing into the air chamber 400 flows into the combustion chamber 12 via the nozzle holes 331, 332 and the air holes 340. In the combustion chamber 12, the combustion air 102 supplied via the nozzle holes 331, 332 and the air holes 340 and the pilot fuel 51 sprayed from the pilot nozzle 53 mix with each other and are burnt to form flames 55. If the combustor 3 is ignited in this way, the combustion gas 140 is supplied to the turbine 4 and the turbine 4 is increased in speed along with the increased flow rate of the pilot fuel 51. Further, the starting motor 8 is disengaged from the turbine shaft so that the gas turbine shifts to self-sustained operation, thereby reaching full speed no-load. After the gas turbine reaches the full speed no-load, the generator 6 is connected with total grid. Further, the turbine 4 is increased in input gas temperature along with the increased flow rate of the pilot fuel 51 to increase a load.

Thereafter, as the flow rate of the pilot fuel 51 is increased to increase the load, the combustor 3 shifts to mixed combustion operation with the pilot fuel 51 by supplying the low BTU gas 61*a*, 61*b*. Further, the flow rate of the low BTU gas 61*a*, 61*b* is increased and the supply of the pilot fuel 51 is stopped. Thus, the combustor 3 shifts to gas single combustion operation by the low BTU fuel 61*a*, 61*b*.

During the operation on the pilot fuel 51, the combustion air 102 is supplied from the nozzle holes 331, 332 of the first perforated plate 316 to the combustion chamber 12. When the low BTU gas 61*a*, 61*b* is started to be jetted from the gas nozzles 320, it is jetted from the nozzle holes 331, 332 of the first perforated plate 316 into the combustion chamber 12. During the mixed combustion operation on the pilot fuel 51 and the low BTU gas 61*a*, 61*b*, the supply flow rate of the low BTU gas 61*a*, 61*b* is low; therefore, the low BTU gas 61*a*, 61*b* is supplied from the nozzle holes 331, 332 as a mixture (premixed flammable mixture) with the combustion air 102. If the flow rate of the low BTU gas 61*a*, 61*b* is further increased, the proportion of the low BTU gas 61*a*, 61*b* jetted from the nozzle holes 331, 332 is increased. The supply pressure of the low BTU gas 61*a*, 61*b* is higher than that of the combustion air 102 and each of the nozzle holes 331, 332 is designed to have the diameter smaller than the jet hole diameter of the gas nozzle 320. Thus, in the gas single combustion operation in which the supply flow rate of the low BTU gas 61*a*, 61*b* is increased, as shown in FIG. 4, partial low BTU gas 61*c* that cannot pass through the jet hole portion 357 of each of the nozzle holes 331, 332 passes through the passage portion 358 and flows into the air chamber 400. The partial low BTU gas 61*c* flowing into the air chamber 400 is jetted into the combustion chamber 12 along with the combustion air 102 via the air holes 340 provided in the first perforated plate 316. As described above, the air chamber 400 plays a role of a gas header adapted to supply an adjacent air hole 340 with the partial low BTU gas 61*c* that was not able to pass through the jet hole portion 357 of each of the nozzle holes 331, 332.

As described above, during the mono-fuel combustion operation on the low BTU gas 61*a*, 61*b*, the partial low BTU gas 61*c* passes through the air passage 358 and flows into the air chamber 400, and the combustion air 102 of the air chamber 400 does not enter the air passage 358. Therefore, only the low BTU gas 61*a*, 61*b* is basically jetted not along with the combustion air 102 from the nozzle holes 331, 332 and forms corresponding flames 57, 56.

(Function and Effect)

1. Compatibility Between the Suppression of the Back-Flow of Combustion Gas and Stable Combustion During Mono-Fuel Combustion of Low BTU Fuel Achievement of Dual Combustion of Pilot Fuel and Low BTU Fuel As shown in FIG. 2, during the mono-fuel combustion operation on the pilot fuel 51, the low BTU gas 61*a*, 61*b* is not jetted from the gas nozzle 320. However, the flow of the combustion air 102 passing through each of the nozzle holes 331, 332 surrounds the neighborhood of the leading end of the gas nozzle 320. It is possible therefore to suppress the inflow of the combustion gas from the combustion chamber 12 into the jet hole of the gas nozzle 320. Thus, it is possible to prevent the combustion gas 140 from back-flowing into the gas nozzle 320 and flowing into another burner via the gas nozzle 320 during the mono-fuel combustion operation on the pilot fuel 51 without the additional preparation of a purge air supply system for preventing the back-flow of combustion gas.

During the mixed combustion operation on the low BTU gas 61*a*, 61*b* and the pilot fuel 51, the jet amount of the low BTU gas 61*a*, 61*b* is still not sufficient. The low BTU gas 61*a*, 61*b* jetted from the gas nozzles 320 forms a jet flow coaxial with the combustion air 102 flowing through the nozzle holes 331, 332. In addition, the low BTU gas 61*a*, 61*b* is mixed with the combustion air 102 and supplied as a premixed flammable mixture into the combustion chamber 12. However, at this point of time, the flames 55 formed by the pilot nozzle 53 are held as an ignition source. Thus, combustion stability can be maintained.

During the mono-fuel combustion operation on the low BTU gas 61*a*, 61*b*, the mixed amount of the combustion air 102 with the low BTU gas 61*a* and 61*b* jetted from the nozzle holes 331 and 332, respectively, can be reduced as described above. As a result, the first burner portion 301 can stably form the flames 57 by diffusion combustion of the low BTU gas 61*a* jetted from the nozzle holes 331 and the combustion air 102 jetted from the air holes 340 adjacent to the corresponding nozzle holes 331. Also the flames 56 formed by the second burner portion 302 can be held by using the flames 57 as an ignition source. Thus, also during the mono-fuel combustion operation on the low BTU gas 61*a*, 61*b*, combustion stability can be ensured.

At the time of start-up when the low BTU gas 61*a*, 61*b* is not supplied, the combustion air 102 is jetted from the nozzle holes 331, 332, which suppresses the inflow of the combustion gas 140 into the gas nozzles 320. On the other hand, if the supply quantity of the low BTU gas 61*a*, 61*b* is increased, the partial low BTU gas 61*c* serves as seal gas to suppress the inflow of the combustion air 102 from the air chamber 400 into the nozzle holes 331, 332. In addition, only the low BTU gas 61*a*, 61*b* is generally jetted from the nozzle holes 331, 332. Thus, also when the gas turbine is operated on the pilot fuel 51 such as liquid fuel, combustion stability can be ensured even during the mono-fuel combustion operation on the low BTU gas 61*a*, 61*b* without the necessity of an additional purge air system for preventing the back-flow of high-temperature combustion gas 140.

If the burner is configured to omit the second perforated plate 315 and eliminate the air chamber 400, the partial low BTU gas 61*c* that has not passed through the jet hole portion 357 of each of the nozzle holes 331, 332 forms a premixed flammable mixture with the combustion air 102 on the upstream side of the first perforated plate 316 during mono-fuel combustion operation. The concentration of the premixed flammable mixture thus formed is different depending on the jet position and jet amount of the low BTU gas 61*c* and the mixing process with the combustion air 102. In addition, burning velocity is different depending on the concentration of the premixed flammable mixture. Therefore, if the premixed flammable mixture is formed on the upstream side of the first perforated flame 316 as described above, unintended flames are likely to be held separately from the flames 56, 57. Thus, the provision of the air chamber 400 as in the present embodiment can suppress the holding of the unintended flames and then enhance the reliability of the combustor.

The nozzle holes 331, 332 and air holes 340 of the first perforated frame 316 are each inclined so as to give a swirl component to each of the fuel jet flow and air jet flow; therefore, a flame-holding region where the fuel flow and the air flow have low velocities is formed in the vicinity of the radially central portion of the burner. Thus, combustion stability can be more enhanced.

2. Suppression of the Metal Temperature of the Burner

To achieve the mono-fuel combustion operation on the low BTU gas 61*a*, 61*b*, the burner tends to increase in area to jet the low BTU gas 61*a*, 61*b* in large quantity for combustion. The combustor that assumes the mono-fuel combustion operation on the low BTU gas 61*a*, 61*b* has a problem in that an increasing surface area which confronts flames formed in the combustion chamber raises the metal temperature of a burner end face. Also during the mono-fuel combustion operation on the pilot fuel 51, the metal temperature of the burner end face around the pilot nozzle 53 is likely to rise.

On the other hand, in the present embodiment, air flowing into the air chamber 400 from the cooling holes 330 provided in the second perforated plate 315 can be allowed to collide with a portion of the first perforated plate 316 around the pilot nozzle 53. Thus, impinging jet can cool the portion of the first perforated plate 316 around the pilot nozzle 53.

In this case, to reduce the metal temperature of the burner end face, measures are taken in which cooling holes are generally bored in the surface of the burner end face and cooling air is supplied to the cooling holes. However, particularly for the mono-fuel combustion operation on low BTU gas, supply of the cooling air to the combustion chamber lowers the temperature of the flame-holding region, which may cause blowout.

Also in this case, in the present embodiment, it is not necessary to install cooling holes for jetting cooling air in the first perforated plate 316. Thus, it is possible to suppress the lowering of the flame temperature of the flame-holding region due to the supply of cooling air during the burning of the low BTU gas and then to suppress the unstable combustion due to the lowered flame temperature.

Meanwhile, during the operation on the pilot fuel 51, there is concern about a lack of oxygen around the pilot nozzle 53.

However, in the present embodiment, the combustion air 102 is jetted from the nozzle holes 331, 332 during the operation on the pilot fuel 51. This eliminates the lack of oxygen around the pilot nozzle 53 and thus the occurrence of particulate matter can be suppressed. Additionally, the combustion air 102 is supplied from the nozzle holes 331 around the pilot nozzle 53 to suppress the elongation of the flames 55 due to the pilot fuel 51. Thus, combustion efficiency can be increased.

Incidentally, as shown in FIG. 3, the present embodiment exemplifies the configuration in which the cooling holes 330 are installed at positions on the radial inside (closer to the pilot nozzle 53) of the nozzle holes 331 and air holes 340 of the first burner portion 301. If a region where the metal temperature of the perforated plate 316 is raised is additionally assumed, it is only necessary to install the cooling holes 330 in the second perforated plate 315 at respective positions corresponding to such a region.

Second Embodiment

Figure 5:
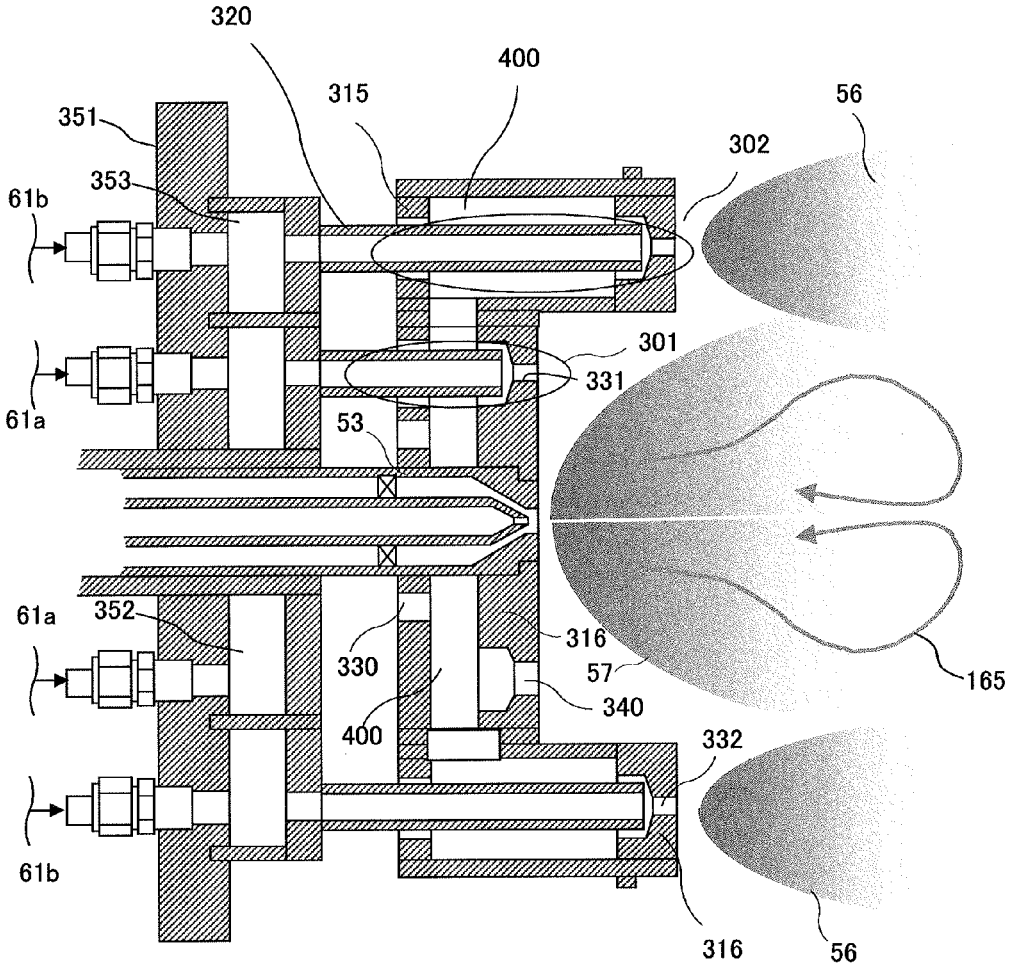
FIG. 5 is a cross-sectional view of a burner showing a second characteristic of the present invention.

FIG. 5 is an enlarged cross-sectional view of a burner provided for a gas turbine according to a second embodiment of the present invention and corresponds to FIG. 4. The same members in this figure as those in FIGS. 1 to 4 are denoted by like reference numerals and their explanations are omitted.

The present embodiment is different from the first embodiment in the following point. A portion (a second burner portion 302) protrudes more toward the downstream side in the flow direction of the combustion gas 140 than does a portion (a first burner portion 301). The portion (the second burner portion 302) has the nozzle holes 332 arranged in a row at the outer circumferential side of a plurality of rows of the nozzle holes 331, 332 in the first perforated plate 316. The portion (the first burner portion 301) has the nozzle holes 331 arranged in a row at the inner circumferential side. In the present embodiment, the second burner portion where the nozzle holes 332 of the first perforated plate 316 are installed protrudes toward the downstream side with respect to the first burner portion where the nozzle holes 331 are installed. Therefore, the gas nozzles 320 inserted into the corresponding nozzle holes 332 are installed to extend toward the downstream side compared with those of the first embodiment in accordance with the protrusion. The other configurations are the same as those of the first embodiment.

The present embodiment can be expected to produce the following effect in addition to the same effects as those of the first embodiment.

During the combustion of the low BTU gas 61*a*, 61*b*, the low BTU gas 61*a*, 61*b* and the combustion air 102 are jetted in the swirl direction from the first perforated plate 316. Therefore, a recirculation zone 165 is formed downstream of the first burner portion 301. The recirculation zone 165 forms flames 57 with the vicinity of the radially central portion of the first perforated plate 316 serving as a flame anchor point. The flames 57 are enlarged in the radial direction as they go downstream. In the present embodiment, since the second burner portion 302 is protruded toward the combustion chamber 12, the nozzle holes 332 can be brought close to the flames 57 enlarged in the radial direction. The heat of the flames 57 formed by the first burner portion 301 can positively be used to hold the flames 56. The flame-holding of the second burner portion 302 can be reinforced. Thus, the further stable combustion of the low BTU gas 61*a*, 61*b* can be expected.

The flow rate of the low BTU gas 61*a* and 61*b* to be supplied to the first burner portion 301 and the second burner portion 302, respectively, is controlled according to a gas turbine load. A mass flow rate (F/A) of the low BTU gas 61*a* from the first burner portion 301 to the combustion air 102 is made nearly constant. Thus, the further combustion stability of the flames 57 can be expected. In this case, because of the lowered calorie of the gas, the low BTU gas 61*b* jetted from the second burner portion 302 is likely to lower the temperature of the flames 57 formed in the first burner portion 301. However, the second burner portion 302 is protruded downstream from the first burner portion 301 in the present embodiment. Thus, the lowered temperature of the flames 57 can be suppressed so that stable combustion can be expected under wide load conditions.

Third Embodiment

Figure 6:
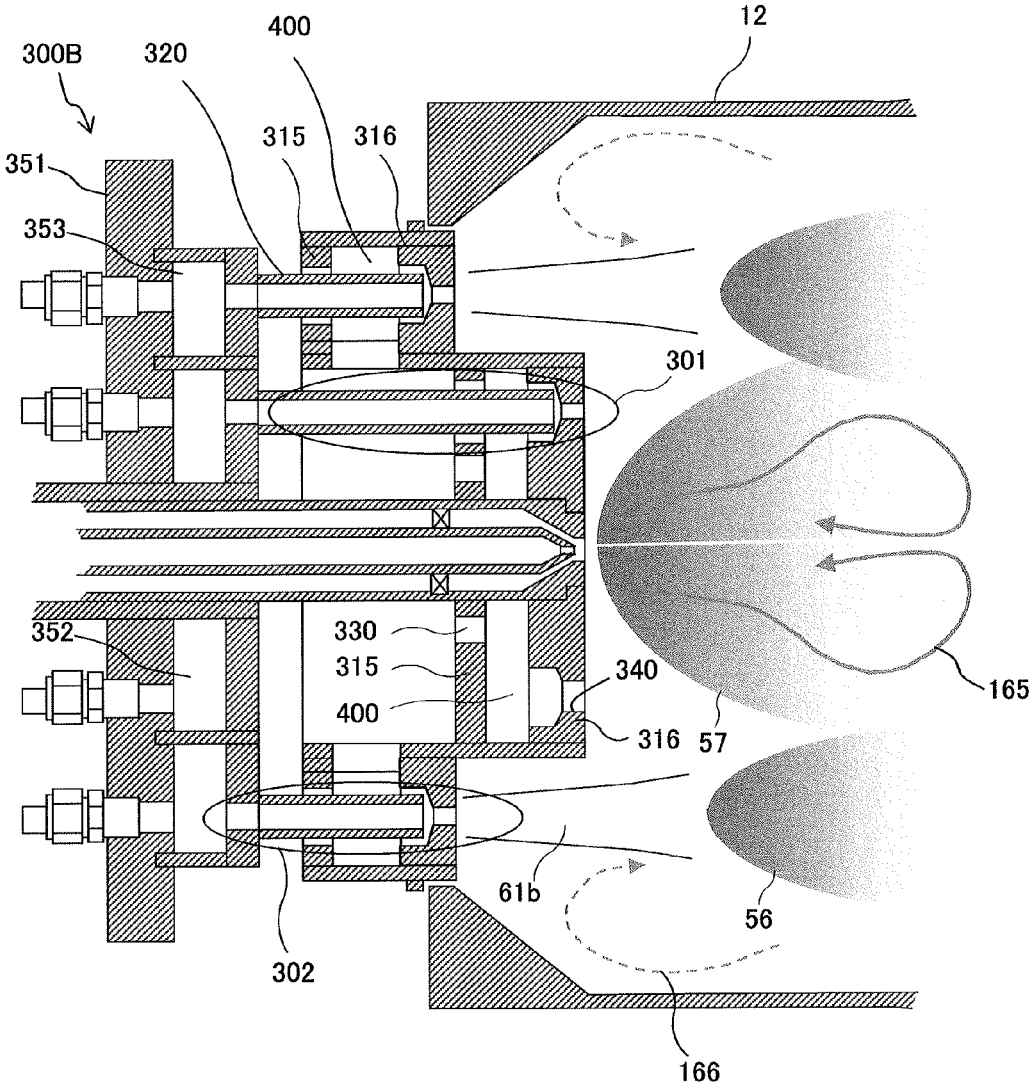
FIG. 6 is a cross-sectional view of a burner showing a third characteristic of the present invention.

FIG. 6 is an enlarged cross-sectional view of a burner provided for a gas turbine according to a third embodiment of the present invention and corresponds to FIG. 4. The same members in this figure as those in FIGS. 1 to 5 are denoted by like reference numerals and their explanations are omitted.

The present embodiment is different from the first embodiment in the following point. A portion (a first burner portion 301) protrudes more toward the downstream side in the flow direction of the combustion gas 140 than does a portion (a second burner portion 302). The portion (the first burner portion 301) has the nozzle holes 331 arranged in arrow at the inner circumferential side of the plurality of rows of the nozzle holes 331, 332 in the first perforated plate 316. The portion (the second burner portion 302) has the nozzle holes 332 arranged in a row at the outer circumferential side. In the present embodiment, the first burner portion where the nozzle holes 331 of the first perforated plate 316 are installed protrudes toward the downstream side with respect to the second burner portion where the nozzle holes 332 are installed. Therefore, the gas nozzles 320 inserted into the corresponding nozzle holes 331 and the pilot nozzle 53 are installed to extend toward the downstream side compared with those of the first embodiment in accordance with the protrusion. The other configurations are the same as those of the first embodiment.

The present embodiment can be expected to produce the following effect in addition to the same effects as those of the first embodiment.

As described in the second embodiment, the recirculation zone 165 is formed downstream of the first burner portion 301. The recirculation zone 165 forms flames 57 with the vicinity of the radially central portion of the perforated plate 316 serving as a flame anchor point. The flames 57 are enlarged in the radial direction as they go downstream. While mixing with ambient air, the gas fuel 61*b* jetted from the second burner portion 302 is exposed to the heat from the flames 57 formed by the first burner portion 301 to form flames 56. In other words, in the present embodiment, the flames 56 are formed closer to the downstream than those in the first embodiment. Thus, since the combustion gas 166 circulates on the outer circumferential side of the second burner portion 302 and in the vicinity of the perforated plate 316, the low BTU gas 61*b* jetted from the second burner portion 302 can be preheated by the flames 56. As a result, the low BTU gas 61*b* jetted from the second burner portion 302 is preheated by the heat of the flames 57 formed by the first burner portion 301 and by the recirculation of the combustion gas 166 occurring on the outer circumferential side of the combustion chamber 12. Thus, it can be expected that combustion stability of the low BTU gas will further be increased.

What is claimed is:

1. A combustor comprising:

a combustion chamber;

a first perforated plate disposed upstream of the combustion chamber in the flow direction of combustion gas, the first perforated plate including a plurality of nozzle holes and air holes facing the inside space of the combustion chamber;

a second perforated plate disposed on a side opposite the combustion chamber with the first perforated plate put therebetween; and a plurality of gas nozzles each of which is inserted from the second perforated plate side into a corresponding one of the nozzle holes of the first perforated plate;

wherein the gas nozzle has a leading end located inside the corresponding nozzle hole, the nozzle hole includes a jet hole portion having a diameter smaller than that of a gas jet hole of the gas nozzle and opposed to the combustion chamber side of the gas nozzle, and a passage portion designed to form an air passage on an outer circumference of the leading end of the gas nozzle in such a manner as to surround the gas nozzle, and an air chamber communicating the air passage with the air hole is defined between the first perforated plate and the second perforated plate.

2. The combustor according to claim 1, wherein the first perforated plate includes nozzle holes and air holes arranged alternately in a circumferential direction.

3. The combustor according to claim 1, wherein the first perforated plate includes nozzle holes concentrically arranged in plural rows.

4. The combustor according to claim 3, wherein the first perforated plate includes a first portion and a second portion, the first portion having the nozzle holes arranged in a row at the outer circumferential side of the first perforated plate, the second portion having the nozzle holes arranged in a row at the inner circumferential side of the first perforated plate, and wherein the first portion protrudes more toward the downstream in the flow direction of combustion gas than does the second portion.

5. The combustor according to claim 3, wherein the first perforated plate includes a first portion and a second portion, the first portion having the nozzle holes arranged in a row at the outer circumferential side of the first perforated plate, the second portion having the nozzle holes arranged in a row at the inner circumferential side of the first perforated plate, and wherein the second portion protrudes more toward the downstream in the flow direction of combustion gas than does the first portion.

6. The combustor according to claim 1, wherein the second perforated plate includes a cooling hole pierced through the second perforated plate such that the cooling hole is opposed to the first perforated plate.

7. The combustor according to claim 6, wherein the cooling hole is located radially inward of the gas nozzles.

8. The combustor according to claim 1, wherein the second perforated plate includes a plurality of through holes each adapted to receive the gas nozzle inserted therethrough and to form an air passage on an outer circumference of the gas nozzle.

9. The combustor according to claim 1, further comprising:

a pilot nozzle installed at a central portion of the first perforated plate.

10. A burner comprising:

a first perforated plate having a plurality of nozzle holes and air holes facing the inside space of a combustion chamber;

a second perforated plate disposed on a side opposite the combustion chamber with the first perforated plate put therebetween; and a plurality of gas nozzles each of which is inserted from the second plate side into a corresponding one of the nozzle holes of the first perforated plate;

wherein the gas nozzle has a leading end located inside the corresponding nozzle hole, the nozzle hole includes a jet hole portion having a diameter smaller than that of a gas jet hole of the gas nozzle and opposed to the combustion chamber side of the gas nozzle, and a passage portion designed to form an air passage on an outer circumference of a leading end of the gas nozzle in such a manner as to surround the gas nozzle, and an air chamber communicating the air passage with the air hole is defined between the first perforated plate and the second perforated plate.

11. A gas turbine comprising:

a compressor for compressing air;

a combustor for burning combustion air compressed by the compressor along with fuel; and a turbine for obtaining rotational power from combustion gas produced by the combustor;

wherein the combustor includes:

a combustion chamber;

a first perforated plate disposed upstream of the combustion chamber in the flow direction of combustion gas, the first perforated plate including a plurality of nozzle holes and air holes facing the inside space of the combustion chamber;

a second perforated plate disposed on a side opposite the combustion chamber with the first perforated plate put therebetween; and a plurality of gas nozzles each of which is inserted from the second perforated plate side into a corresponding one of the nozzle holes of the first perforated plate; and wherein the gas nozzle has a leading end located inside the corresponding nozzle hole, the nozzle hole includes a jet hole portion having a diameter smaller than that of a gas jet hole of the gas nozzle and opposed to the combustion chamber side of the gas nozzle, and a passage portion designed to form an air passage on an outer circumference of a leading end of the gas nozzle in such a manner as to surround the gas nozzle, and an air chamber communicating the air passage with the air hole is defined between the first perforated plate and the second perforated plate.

* * * * *